US006592393B1

(12) United States Patent
Gentle

(10) Patent No.: US 6,592,393 B1
(45) Date of Patent: Jul. 15, 2003

(54) PORTABLE GROUND FAULT INTERRUPT CONNECTOR

(76) Inventor: Jeffory J. Gentle, 14415 N. 28th Ave., Phoenix, AZ (US) 85053

( * ) Notice: Subject to any disclaimer, the term of this patent is extended or adjusted under 35 U.S.C. 154(b) by 0 days.

(21) Appl. No.: 10/118,119

(22) Filed: Apr. 8, 2002

(51) Int. Cl.[7] ..... H01R 13/62
(52) U.S. Cl. ..... 439/369; 361/42
(58) Field of Search ..... 439/369–370; 361/42

(56) References Cited

U.S. PATENT DOCUMENTS

| | | | |
|---|---|---|---|
| 4,884,979 | A | 12/1989 | Budner |
| 4,907,984 | A | 3/1990 | Keller |
| 5,102,345 | A | 4/1992 | Stanwick et al. |
| 5,587,864 | A | 12/1996 | Gale et al. |
| 5,755,588 | A | 5/1998 | Sweatman et al. |
| 5,913,692 | A | 6/1999 | Targett |
| 6,171,132 | B1 | 1/2001 | Schmidt |

*Primary Examiner*—Gary Paumen
*Assistant Examiner*—James R. Harvey

(74) *Attorney, Agent, or Firm*—Jones, Waldo, Holbrook & McDonough

(57) ABSTRACT

A portable ground fault interrupt (GFI) connection. More particularly, there is an electrical cord connector that has both a GFI feature and is moisture resistant. In particular there is a housing portion designed to securely hold a first and second electrical cord therein; a GFI device located inside the housing, designed to be connected to the first and second electrical cords; and a restraining portion, located withing the housing, designed to securely restrain the first and second electrical cords withing the housing and to inhibit moisture from seeping withing the housing. The electrical cord connector further includes the restraining portion that comprises a flexible foam material. The housing has a top and bottom portion. The GFI device includes a male and female coupling for being coupled to a corresponding male and female end of an electrical cord respectively. The housing comprises a torpedo related shape where the first and second electrical cords enter the housing at the pointed ends of the torpedo related shape. The GFI device includes a reset button. The reset button extends through the housing and is accessible from outside the housing. The housing has a cavity positioned to enable a plug on the first electrical cord to fit withing the housing and be connected to the GFI.

12 Claims, 3 Drawing Sheets

PORTABLE GROUND FAULT INTERRUPT CONNECTOR

FIELD OF THE INVENTION

The present invention relates to a portable ground fault interrupt (GFI) connector. More particularly, there is an electrical cord connector that has both a GFI feature and is moisture resistant.

BACKGROUND OF THE INVENTION

For many years now, our society has had a sharp increase in the use of portable electrical tools for outside use. Consequently the use of electrical cords outside of buildings has also sharply increased. The typical home owner, for example, may use an electrical lawn mower, an electrical weed cutter, or an electrical leaf blower. A typical work site, also, typically uses electrical saws, electrical lights, or electrical nail guns.

However, this incessant need for more and more electrical tools has not come without a price. Every year thousands of individuals have been injured or even died as a result of electrocution from using these same tools in moisture laden environments. Simply put, electricity and water are not beneficial companions. One of the most common causes of this societal cancer is that most users simple do not have electrical cords that extend or reach as far as is necessary. Therefore, as a common fix to this situation, the user simply connects two cords together.

In and by itself, this two cord connection system is not a problem. However, most all lawns or work sites are often besieged by moist environments. Specifically, a work site can have standing puddles, a lawn often has just been watered by sprinkler systems, or morning dew is often laying on the grass.

One profession in particular, has a very high occurrence of standing water that is extremely dangerous for electrical cords. Fireman in their every day professional operation need many electrical tools. For example, electrical fans are needed to move air around after fires are extinguished, electrical saws are needed to cut access holes, for example, before, during and after a fire. When these electrical cords are employed, the connection points of these cords often are located near if not in standing water. As is often the case, a fireman will contact the electrified water and experience an unpleasant event at the least and a deadly one at most.

Accordingly, a need exists for a connector device that allows for the continued use of connecting two or more electrical cords in moist environments, yet prevents, eliminates or at least greatly decreases the risk of electrocution to those persons that must work in those environments.

PRIOR ART

Examples of patents related to various electrical cord connection and ground fault interrupt (GFI) devices are legion, each of the following prior art patents are incorporated by reference for its supporting teachings:

- U.S. Pat. No. 6,171,132 B1 is a cover for cable connectors and the like.
- U.S. Pat. No. 5,913,692 to an electrical cord locking assembly.
- U.S. Pat. No. 5,755,588 to a retention enclosure for in-line electrical plugs.
- U.S. Pat. No. 5,587,864 to a short circuit and ground fault protection for an electrical system.

None of the foregoing prior art references address the need for a device that allows for the continued use of electrical tools in moist environments, yet prevents, eliminates or at least greatly decreases the electrocution nemesis.

SUMMARY OF THE INVENTION

There is a device for portable ground fault interrupt (GFI) connection. More particularly, there is an electrical cord connector that has both a GFI feature and is moisture resistant.

There is additionally a device that provides for an electrical cord connector device, comprising a housing portion designed to securely hold a first and second electrical cord therein; a GFI device located inside the housing, designed to be connected to the first and second electrical cords; and a restraining portion, located withing the housing, designed to securely restrain the first and second electrical cords withing the housing and to inhibit moisture from seeping withing the housing.

Additionally, the electrical cord connector further includes the restraining portion that comprises a flexible foam material. The housing has a top and bottom portion. The GFI device includes a male and female coupling for being coupled to a corresponding male and female end of an electrical cord respectively. The housing comprises a torpedo related shape where the first and second electrical cords enter the housing at the pointed ends of the torpedo related shape. The GFI device includes a reset button. The reset button extends through the housing and is accessible from outside the housing. The housing has a cavity positioned to enable a plug on the first electrical cord to fit withing the housing and be connected to the GFI. The materials making up the housing and interior portions of the invention are made with components that inhibit the formation of fire and/or smoke.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION OF THE PREFERRED EMBODIMENT(S)

The present invention relates to a portable ground fault interrupt (GFI) electrical cord connector system. More particularly, there is an electrical cord connector that has both a GFI feature and is moisture resistant.

Figure 1:
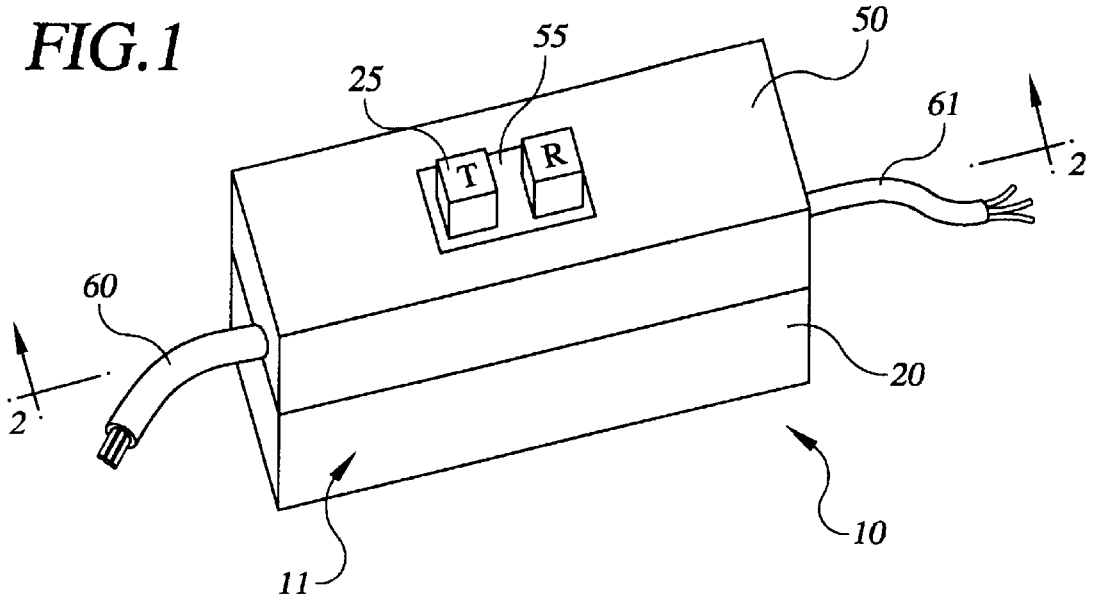
FIG. 1 is an isometric view of a general embodiment of the invention.

In FIG. 1 there is shown an isometric view of a general embodiment of an electrical cord connector system 10. When the connector 10 comprises key elements that are viewable from the exterior of the housing 11. Specifically, housing 11 includes a bottom housing portion 20 and a top housing portion 50. The top 50 has a hole 55 located therein that allows for control buttons 25 to be accessed. Control buttons typically may include a test "T" and a reset "R" button, but the invention is not limited to these in particular. Two electrical cords 60 and 61 are illustrated extending from the housing 11.

Figure 2:
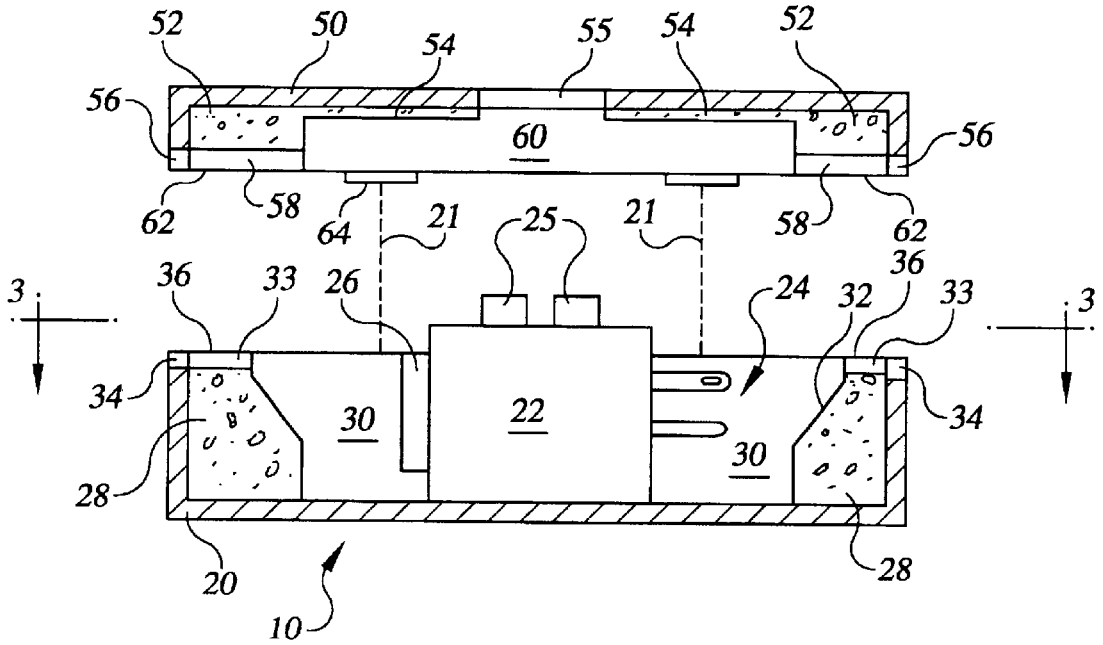
FIG. 2 is a side-sectional view of FIG. 1 according to the general embodiment of the invention.

FIG. 2 illustrates a sectional side view of an expanded separated view of FIG. 1. Specifically, top 50 is separated from bottom 20 via dashed lines 21. Uniquely, bottom 20 includes several elements. There is a typical common GFI (ground fault interrupt) device 22, which has the control buttons 25, male plug portions 24, and female plug receptacle portions 26 located thereon. There is also a flexible form type material 28, which acts as a restraining device to at least restrain the cords 60 and 61 within the housing and to inhibit moisture from entering therein, and is located at either end of the inside of the bottom 20. The foam 28 is located at both ends of the housing 11, and includes a groove 33 formed along a top section that defines side walls 36 of the groove 33. There is also a slanted section 32 that is designed to accommodate a plug located at the end of a typical electrical cord. There are also holes 34 corresponding to each of the grooves 33.

The top portion 50 has several key elements that correspond to elements located in the bottom portion 20. Specifically, there is a flexible foam portion 52 and 54, a groove 58, side walls 62 formed by groove 58, and corresponding holes 56.

Figure 3:
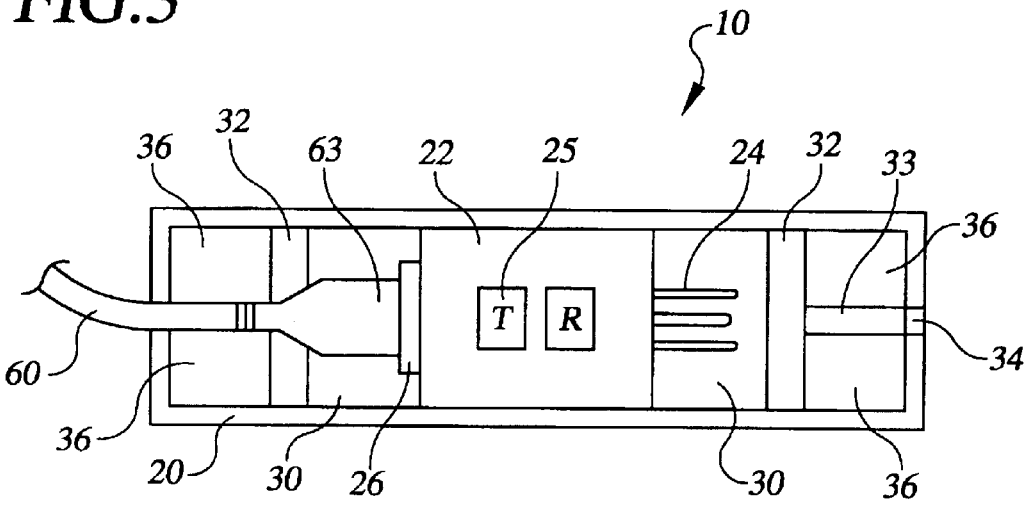
FIG. 3 is an inside view of the bottom portion of the general embodiment of FIG. 2.

FIG. 3 illustrates a top view looking into the bottom portion 20 of housing 11. Uniquely, there is illustrated electrical cord 60, by way of male plug 63, that is coupled to the female connector portion of the GFI 22. The cord extends through hole 34, along groove 33, into cavity 30 and has male plug 63 connect to the female connector portion 26. Likewise, though not illustrated, a skilled artisan will understand that electrical cord 61 would extend through hole 34, groove 33, cavity 30 and have a female plug connect to male portions 24. Additionally, top portion 50 (not shown) would be shut over the cords 60 and 61 to form a tight water resistant seal around all respective portions of the system to prevent moisture from entering into cavity 30 and eventually preventing moisture from contacting electrical male and female portions 24 and 26. Thus, preventing electrocution of workers using this invention in water laden environments.

It is noted that flexible foam portions 28, 52 and 54 are sized to be smaller than matching portions that are to fit thereagainst. Thus, for example, the foam would fit securely around the cords 60, 61 to create a water resistant seal. Likewise, the foam portion 54 is designed to fit securely and tightly over the GFI 22 top portion to prevent any moisture from seeping into the hole 55 and over the seal foam portion 54. It is obvious that the foam is designed to fit securely around all related portions when the top portion 50 is releasably secured to the bottom portion 20.

Figure 4:
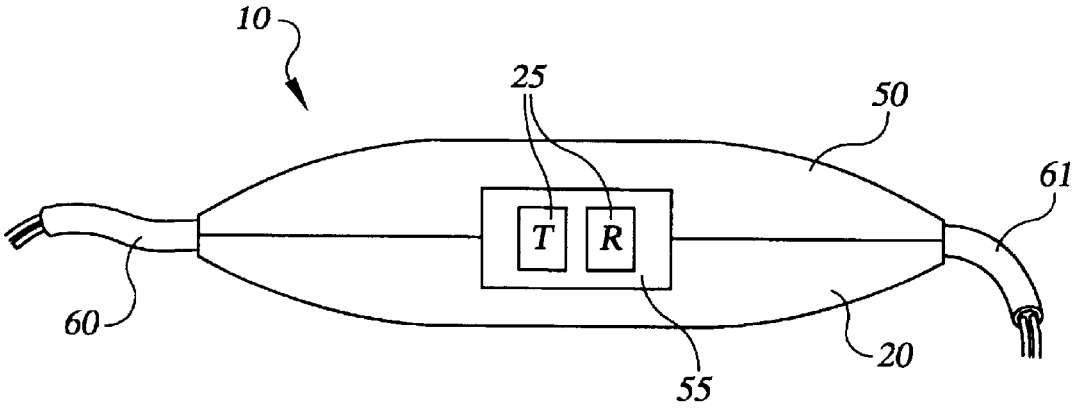
FIG. 4 is a view of another preferred embodiment illustrating a compact torpedo design.

FIG. 4 shows a preferred embodiment of the invention. Specifically, there is illustrated a torpedo shaped design that eliminates unnecessary sections of the internal spaces by utilizing a slender compact design.

Figure 5:
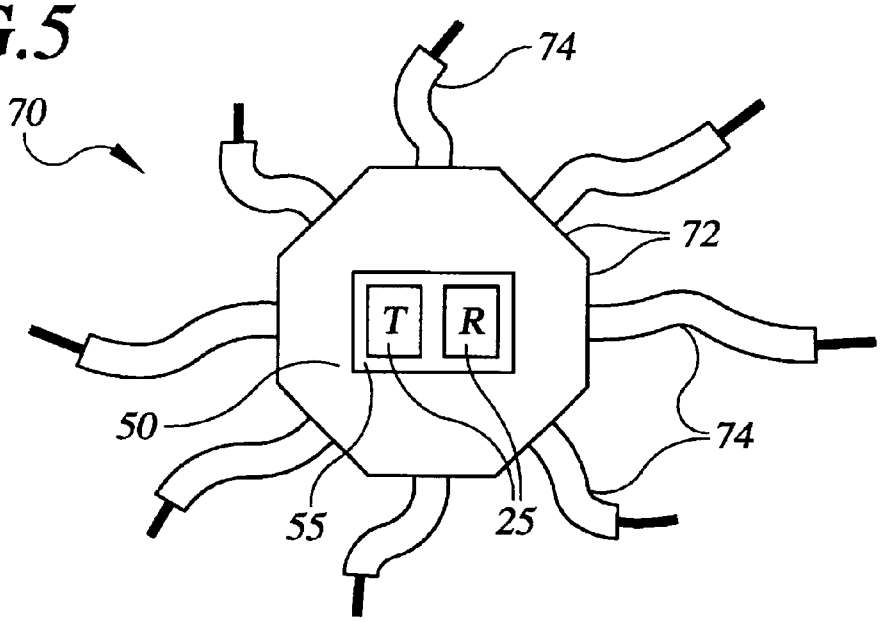
FIG. 5 is a top view of another preferred embodiment illustrating the use of multiple cord connections.

FIG. 5 illustrates another alternative design that accommodates multiple electrical cords. For example, there are multiple unit 70 that has multiple sides 72, that accommodate multiple electrical cords 74.

Figure 6:
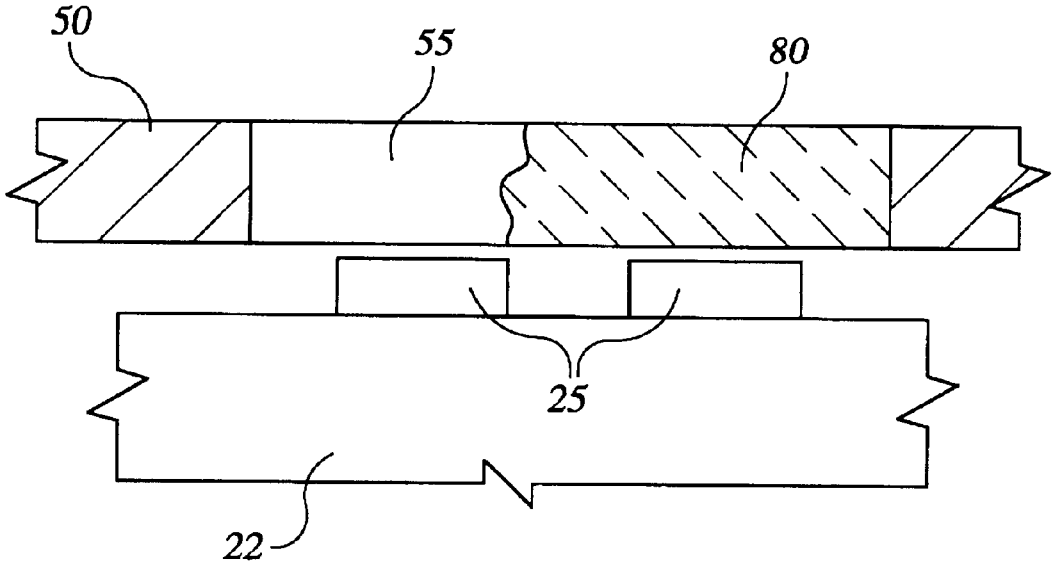
FIG. 6 is a sectional side view of an alternative embodiment.

FIG. 6 is a sectional side view of an alternative embodiment. Specifically, the top portion of the connector housing 50 has a flexible transparent or translucent sheet of material 80 that is inserted into the hole 55. A skilled artisan in the electrical connector art will realize the advantage of using a flexible sheet 80. Specifically, a user can push down on the flexible sheet 80 to actuate the buttons 25 without having the GFI 22 exposed outside the housing, as is the case without having the sheet 80. This at least has the effect of increasing the water resistance of the overall unit.

REMARKS ABOUT THE PREFERRED EMBODIMENT

It is noted that foam 28, 52, and 54 have particular adaptations to securely hold and tightly fit all portions of the interior of the housing to inhibit moisture from entering therein. Specifically, portion 52 matches to the section of foam portion 28 that contains groove 33 and wall sections 36. Thus, the matched foam sections form a tight fitting barrier to moisture from seeping within the housing and gaining easy access to the GFI and plugs.

It is further noted that foam sections 54 are designed to fit tightly against the top surface of GFI 22 when the top portion 50 is closed. Thus, preventing, again, moisture from gaining easy access to the interior of housing 11.

It is further noted that no device can be made to both open and close and to have passageways from the exterior to the interior and have a completely moisture proof design without encountering significant costs. Therefore, the present invention incorporates a GFI 22, which will deactivate the electrical flow when water is sufficiently accumulated to cause potential electrocution of persons coming in contact with the exposed water.

It is noted that the flexible foam does not have to be attached to the housing, it could be friction fit into the housing, ie. wedged into place. The foam could also be glued down to get a tight seal to the housing. It is important that there is a secure fit around the cord so that moisture is retarded from entering into the housing.

The foam 28 may appear to be level or having the same diameter as the opening 34 and 56, however, skilled artisans would realize that having a smaller diameter foam section would be beneficial to further prevent moisture seepage along the passageway used by the cord to have access to the GFI 22. Thus, closing of the device would cause the foam to squeeze around the cord in a tighter fit.

It is noted that the plastic housing may be made of STAREX, which can be purchased at H. Muehlstein & C., 800 Connecticut Ave., Norwalk, Conn. 06854 U.S.A., Phone: 1-800-257-3746. The property of this material allows for the ability to emit a gas that at best extinguishes or at least inhibits fire when it is exposed to a spark or fire conditions. A skilled artisan will konw that this material works when it is exposed to fire sufficient to begin melting, whereby the material will then exhibit the anti-fire characteristics. Although, it is noted and even contemplated to make the housing out of any material that has fire and smoke resistant characteristics.

It is noted that the foam 28 may have the air cells made to contain an inert gas, such as halon, argon, neon or any of the other periodic table inert gases. Additionally, a skilled artisan will easily realize that any other non-flammable gas or a gas that actually inhibits fire or smoke, such as carbon dioxide or nitrogen would also work. The main property of the gas used would have the ability to suppress or consume fire and smoke. Thus, if a cord begins to short or spark the cells in the foam are broken open and then release the fire and/or smoke suppressant gas, thus suppressing the fire conditions.

VARIATIONS IN THE INVENTION

It is noted that there are innumerable variations that could be undertaken in the design of the described invention once a skilled artisan has read the attached specification. For example, the foam is shaped to fit against the electrical plug 63, which is currently illustrated as a slanted section 32. However, a skilled artisan would envision many types of shapes that would be carved into the foam to accommodate a plug 63. For example, a form fitting cavity could be used. Additionally, the foam could extend all the way into the housing, thus eliminating most of the cavity 30 and only making enough room for the plug 63.

By way of illustration, attachment portion 64 is illustrated to demonstrate that there may be many forms of a known attachment device. For example, there could be hinges, snaps, clasps, sliding portions etc.

Another design choice is the inclusion of control buttons 25 inside the housing 11. Specifically, the buttons 25 would not be actuatable from the outside of the housing. It would be required to open the housing to reset the buttons. Additionally, although two buttons are illustrated, there are any combination of buttons that could exist. For example, the test button could be eliminated and there could only be the reset button. More buttons could also exist at the need dictates.

A skilled artisan will realize that although only elementary illustration is made of securing the top and bottom portions of the housing, there are in fact a plethora of design choices available. The main goal of any connection means utilized will be the restraint of moisture to gaining the interior of the housing to prevent electrical shortages. For example, foam may also be used around the edges of the housing, or locking type designs may be utilized.

Although there is illustrated the lower and top portion housing 20 and 50 to have separate walls from the foam portions 28, 52 and 54, it is contemplated to make the housing to be one continuous unit. Specifically, the whole housing could be made of a pliable material that would seal against the electrical cord when the two portions 20 and 50 were closed together.

It is noted that skilled artisans would understand that it would be beneficial to have indicator lights located on the invention. Specifically, a light indicator is designed to show that the GFI is in one of several states, like the state of "on" or "off", indicating that the GFI is tripped or not tripped. The light indicator could be a green and/or red light, it could be one or two separate lights. The lights could be mounted on the exterior of the housing or they could be placed to be viewable through the flexible see-through sheet 80 and placed next to the buttons 25 and mounted on the GFI 22.

Numerous other modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications are contemplated.

What is claimed is:

1. An electrical cord connector device, comprising:

a) a housing portion designed to securely hold a first and second electrical cord therein;

b) a GFI device located inside the housing, designed to be connected to the first and second electrical cords; and c) a restraining portion, located withing the housing, designed to securely restrain the first and second electrical cords withing the housing and to inhibit moisture from seeping into the housing.

2. The device of claim 1, wherein the restraining portion comprises a flexible foam material.

3. The device of claim 1, wherein the housing has a top and bottom portion.

4. The device of claim 1, wherein the GFI device includes a male and female coupling for being coupled to a corresponding male and female end of an electrical cord respectively.

5. The device of claim 1, wherein the housing comprises a torpedo related shape where the first and second electrical cords enter the housing at the pointed ends of the torpedo related shape.

6. The device of claim 1, wherein the GFI device includes a reset button.

7. The device of claim 1, wherein the reset button extends through the housing and is accessible from outside the housing.

8. The device of claim 7, wherein the housing has a cavity positioned to enable a plug on the first electrical cord to fit withing the housing and be connected to the GFI.

9. The device of claim 8, wherein the housing is made of a fire resistant material.

10. The device of claim 9, wherein the fire resistant material is STAREX.

11. The device of claim 2, wherein the flexible foam material further comprises a fire retardant gas in the cells of the foam.

12. The device of claim 11, wherein the fire retardant gas in the cells of the foam consists of a gas selected from the group of noble gases, nitrogen, and carbon dioxide.

* * * * *